US008610380B2

(12) United States Patent
Vaccaro

(10) Patent No.: US 8,610,380 B2
(45) Date of Patent: Dec. 17, 2013

(54) ACCELERATOR PACK, SPECIFICALLY FOR LINEAR ACCELERATION MODULES

(76) Inventor: Vittorio Giorgio Vaccaro, Naples (IT)

( * ) Notice: Subject to any disclaimer, the term of this patent is extended or adjusted under 35 U.S.C. 154(b) by 284 days.

(21) Appl. No.: 12/988,370

(22) PCT Filed: Jul. 18, 2008

(86) PCT No.: PCT/IB2008/052900

§ 371 (c)(1),
(2), (4) Date: Dec. 30, 2010

(87) PCT Pub. No.: WO2009/127908

PCT Pub. Date: Oct. 22, 2009

(65) Prior Publication Data

US 2011/0089871 A1 Apr. 21, 2011

(30) Foreign Application Priority Data

Apr. 16, 2008 (IT) ..... RM2008A0205

(51) Int. Cl.
*H05H 9/00* (2006.01)

(52) U.S. Cl.
USPC ..... 315/505; 315/500; 315/501; 250/281; 376/105; 376/190

(58) Field of Classification Search
USPC ..... 315/505
See application file for complete search history.

(56) References Cited

U.S. PATENT DOCUMENTS 4,155,027 A * 5/1979 Schriber et al. ..... 315/5.41
5,811,943 A * 9/1998 Mishin et al. ..... 315/505

OTHER PUBLICATIONS

Amaldi, U. et al.; "LIBO—a linac-booster for protontherapy: construction and tests of a prototype"; Nuclear Instruments & Methods in Physics Research, Section A: Accelerators, Spectrometers, Detectors, and Associated Equipment, Elsevier, Amsterdam, NL, vol. 521, No. 2-3, Apr. 1, 2004, pp. 512-529.

Berra, P. et al.; "Study, construction and test of a 3 GHz proton linac booster (LIBO) for cancer therapy"; Proceedings of the 7th European Particle Accelerator Conference, Aug. 24, 2000, pp. 2495-2497.

Vaccaro, V.G. et al.; "ACLIP: a 3 GHz side coupled linac for protontherapy to be used as a booster for 30 MeV cyclotrons"; Cyclotrons and Their Applications 18th International Conference; Oct. 1-5, 2007; pp. 172-174.

Vaccaro, V.G. et al.; "Design, construction and low power tests of the first module of the ACLIP linac"; Proceeding of the 9th European Particle Acceleration Conference, Jun. 23-27, 2008, pp. 1836-1838.

* cited by examiner

*Primary Examiner* — Jerome Jackson, Jr.
*Assistant Examiner* — David Lotter
(74) *Attorney, Agent, or Firm* — Gifford, Krass, Sprinkle, Anderson & Citkowski, P.C.

(57) ABSTRACT

An accelerator pack, specifically for linear accelerator modules cascade-connected to a proton-emitting cyclotron, specially adapted for use in cancer therapies. Such a technique is named PT. The pack displays an accelerating cavity of improved efficiency in virtue of its shape, which provides for making a portion of accelerating cavity on both faces of the pack. Furthermore, the pack also contains a coupling cavity portion. In such a manner, the volume of the accelerating cavity is increased as compared to that of the packs of the known accelerator modules.

6 Claims, 4 Drawing Sheets

ACCELERATOR PACK, SPECIFICALLY FOR LINEAR ACCELERATION MODULES

CROSS-REFERENCE TO RELATED APPLICATIONS

This application is the U.S. national phase of PCT/IB2008/052900 filed Jul. 18, 2008, which claims priority of Italian Patent Application No. RM2008A000205 filed Apr. 16, 2008.

FIELD OF THE INVENTION

The present invention relates to a pack belonging to linear accelerators specifically adapted to be used in a cascade with a cyclotron for cancer therapies.

STATE OF THE ART

A technique known as Proton Therapy (or PT) is becoming increasingly common for treating some types of tumours in virtue of its low invasiveness with regard to the healthy cells surrounding the cancer cells as compared to other types of radiotherapy. Furthermore, the use of hadron beams, i.e. light protons and ions, in radiotherapy is turning out to be much more effective than conventional photon and electron radiotherapy systems for various cancer pathologies.

PT however requires the use of cyclotrons which accelerate the protons to a given initial energy: it is estimated that the most appropriate choice is 30 MeV. The protons must however be further accelerated to take their energy to values in the order of 240 MeV in order to be employed in cancer treatment. These post-accelerators, cascade-connected to the cyclotrons, also named linac, are machines capable of accelerating charged particles, such as for example protons, electrons, positrons, heavy ions, etc., at a predetermined energy. The use of a linac may be extremely expensive. Indeed, a power increase of such machines considerably increases costs. On the other hand, since the energy at which the particles must be used in the PT is 240 MeV, said particles must be subsequently further accelerated after the initial acceleration of 30 MeV which is imparted to the particles by the cyclotron. Such a technique is implemented using specific linear accelerators, named linac, cascade-connected to the cyclotron, which consist of specific acceleration modules. Each module consists of a large series of synchronous radiofrequency cavities which determine an acceleration channel along which the particle beam travels.

The acceleration modules are, in turn, formed by joining packs side-by-side in which the several cavities which follow each other along the accelerating channel are obtained.

A PT machine requires the arrangement of as many modules as needed to make the particles acquire an energy of 240 MeV, required for using the PT.

Nowadays, the modules are necessarily made of packs joined together to make it possible to form the various cavities needed to create the resonance effect which is necessary for the particles to acquire their energy when crossing the acceleration module.

These cavities which are obtained in the modules are generally fed at frequencies in the order of 3 GHz, and in some cases such working frequencies are increased up to 6-8 GHz.

Since the cost of the cyclotrons which inject the protons into the linac is high, and proportionally enhances with the power increase, it is preferable to employ low power cyclotrons, by increasing the number of modules of the linac, the cost of which is lower than the cost of a higher power cyclotron. Said acceleration modules are formed by copper packs mechanically processed by removing some material so as to obtain cavities in their thickness S, which cavities produce the particle acceleration by resonating with the magnetic fields generated by the generator. The packs, during the step of assembling, are weld-brazed together so as to form the accelerator modules.

However, the power reduction of the cyclotron and the concurrent increase in the number of accelerator modules to maintain the final power conferred to the particles implies that the size of the packs must be reduced by an inverse ratio to the square root of 2. This required reduction of the packs forces to thin the parts of the pack which are already very small. For example, the partition which delimits the acceleration cavities in the pack thus becomes so thin that, when brazed, it would be deformed.

The various cavity parts which are obtained in the packs are designed so that, once an accelerator module has been assembled by joining the various packs, the acceleration line downstream of the cyclotron will include an appropriate number of modules, thus determined by the desired acceleration to be imparted to the particles.

The accelerating cavities are aligned and reciprocally communicating to form a first alignment. The coupling cavities form two symmetric and alternating alignments with respect to the accelerating cavities, so that the sum of the accelerating cavities is equal to the coupling cavities.

The cavities of each coupling alignment are also reciprocally communicating.

The accelerator alignment and the coupling alignments are reciprocally communicating, by means of appropriate openings, named irises, which extend from each accelerating cavity towards the adjacent coupling cavities. More in detail, two irises open on each side of each partition dividing two accelerating cavities.

This cavity structure is made to allow to control the phase and amplitude of the fields.

Specifically, the conformation of the known art packs provides for making a first accelerating half-cavity by emptying, by means of mechanical processing, a first face of the pack, in an essentially mid-position with respect to the surface of the pack, while the coupling half-cavity is made in the same manner, in an offset position with respect to the aforesaid accelerating cavity and on the opposite side with the respect to said first face.

In such a manner, by assembling the packs, facing the first face of a first pack with another first face of a second pack and a second face of a third pack with the second face of the second pack, a portion of accelerator module is obtained as shown in FIG. 1.

The juxtaposition makes two half-cavities form a complete cavity.

The packs are assembled together by brazing.

A problem of the configuration offered by the known art is that the partition which divides two accelerating cavities cannot be reduced beyond a given limit, because being formed by two adjacent packs, when these are brazed, said portions of packs which form the partition are deformed leading to situations in which the cavity does not resonate.

The attempt to thin said partition should be pursued to increase the volume of each cavity to the maximum. Indeed, the increase of volume of the cavity related to the surface which contains it increases cavity efficiency. As a consequence, it is desirable to reduce the distance between two adjacent cavities as much as possible, thus reducing the dividing partition.

The structural limits of an excessively thin partition may be reached also during the operation of the accelerator because of the very strong magnetic fields which are generated therein and due to the temperatures which are reached.

Furthermore, some deformations may cause a cavity to vent outwards at the joint between two packs which are not perfectly flat.

Therefore, such a configuration of packs for composing the accelerator modules is not very efficient and requires very low machining tolerances because each minimal error may lead to:

reach structural limits in one or more internal partitions, vent one or more cavities outwards, an incorrect volume/surface ratio such as to prevent the cavity from resonating.

SUMMARY OF THE INVENTION

It is the object of the present invention to provide an accelerator pack, for making linear accelerators for the particles produced by cyclotrons which solve the aforesaid drawbacks.

The present invention thus proposes to reach such objects by making an accelerator pack, specifically for linear acceleration modules, in accordance with claim 1.

A further object of the invention is to provide a linear proton accelerator module including a plurality of said packs, as claimed in claim 7.

According to a further aspect of the invention, said accelerator is applied to cancer therapies.

The dependent claims disclose preferred embodiments of the invention.

BRIEF DESCRIPTION OF THE DRAWINGS

Further features and advantages of the present invention will be more apparent in the light of the detailed description of a preferred, but not exclusive, embodiment of an accelerator pack, specifically for linear acceleration modules, illustrated by way of non-limitative example, with the aid of the accompanying drawings, in which.

The same numbers and reference letters in the figures refer to the same elements and components.

DETAILED DESCRIPTION OF A PREFERRED EMBODIMENT OF THE INVENTION

With specific reference to figures from 2 to 6, the pack 1, with a parallelepiped shape, with a small thickness S as compared to the other dimensions, displays two larger surface faces A, B. This pack is made of copper or other metal having a high electric conductivity.

A circular-shaped cavity 11*a* is obtained on the side of the face 1*a* by a process of material removing. A circular-shaped cavity 11*b* concentric to cavity 11*a* is obtained on the side of the face 1*b* by a process of material removing. These two cavities 11*a* and 11*b* have a shape and size so that when the face 1*a* of a pack is overlapping the face 1*b* of another pack, the cavity 11*a* of the first one is facing the cavity 11*b* of the other, so as to form an accelerating cavity 11, arranged in the mid-zone with respect to the whole formed by the two packs.

A major part of a first peripheral cavity 12*a* is further obtained on the face 1*a* of the pack and the remaining part of a second peripheral cavity 12*b* arranged symmetrically to the portion 11*a* or 11*b* of the mid accelerating cavity 11 is obtained on the face 1*b*.

Said cavities 12*a* and 12*b*, as will be more apparent below, cooperate to form a coupling cavity 12.

Figure 1:
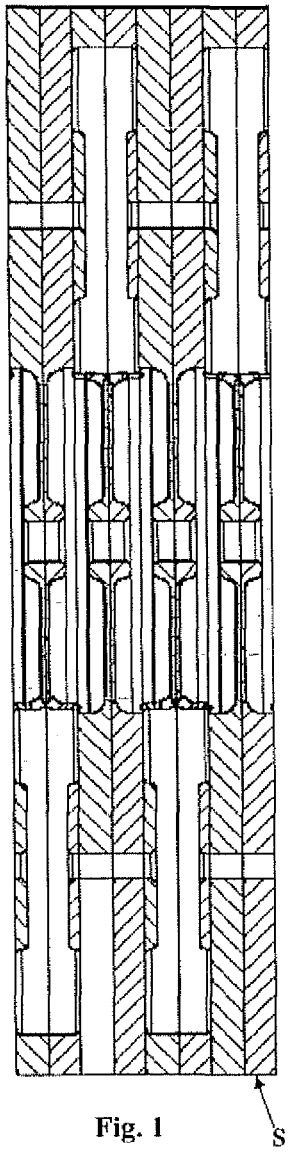
FIG. 1 shows a section of a plurality of packs of the state of the art assembled to form a part of an acceleration module.
Figure 2:
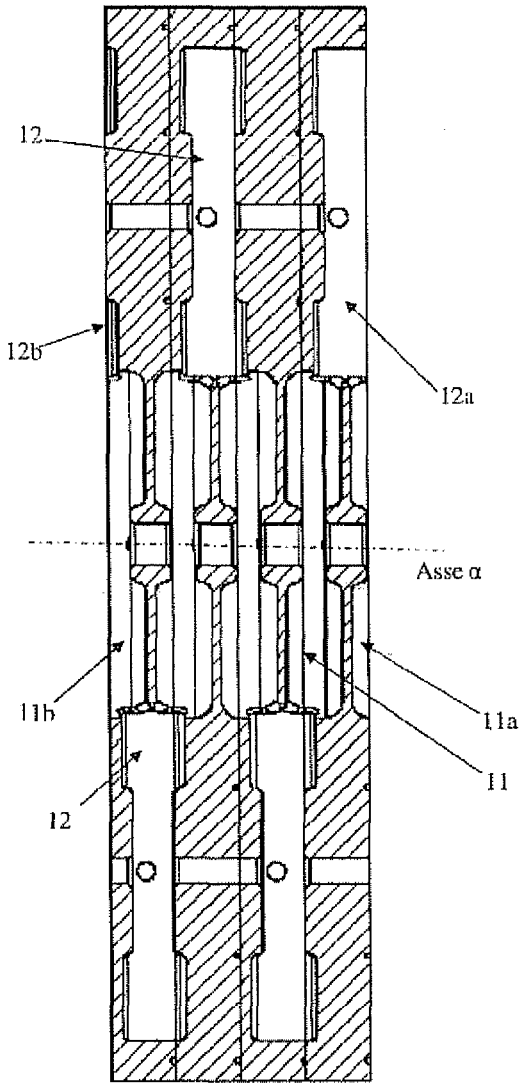
Fig. 2 Prior Art
FIG. 2 shows a section of a plurality of packs object of the present invention assembled to form a part of an acceleration module.
Figure 3:
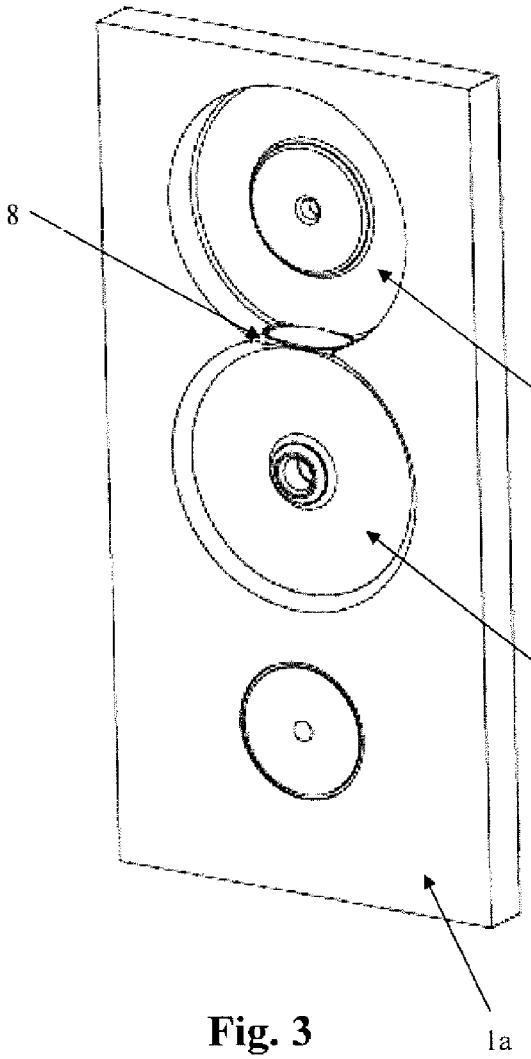
FIG. 3 shows an axonometric view of the face of a pack of the invention.
Figure 4:
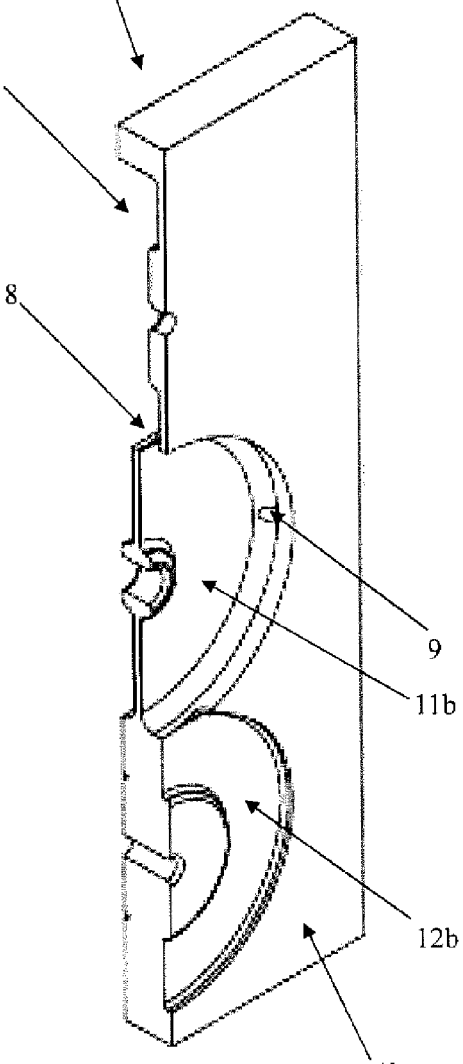
FIG. 4 shows an axonometric view of a section of the pack in FIG. 3.
Figure 5:
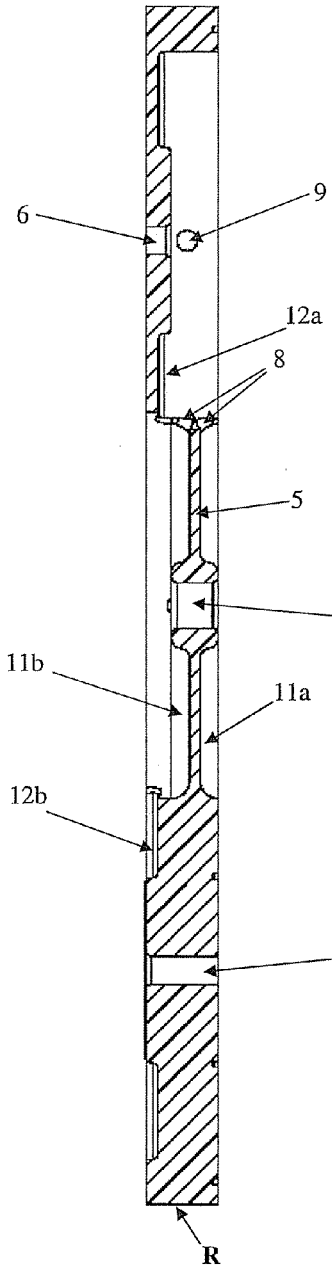
FIG. 5 shows a longitudinal section view of a pack in FIG. 2.
Figure 6:
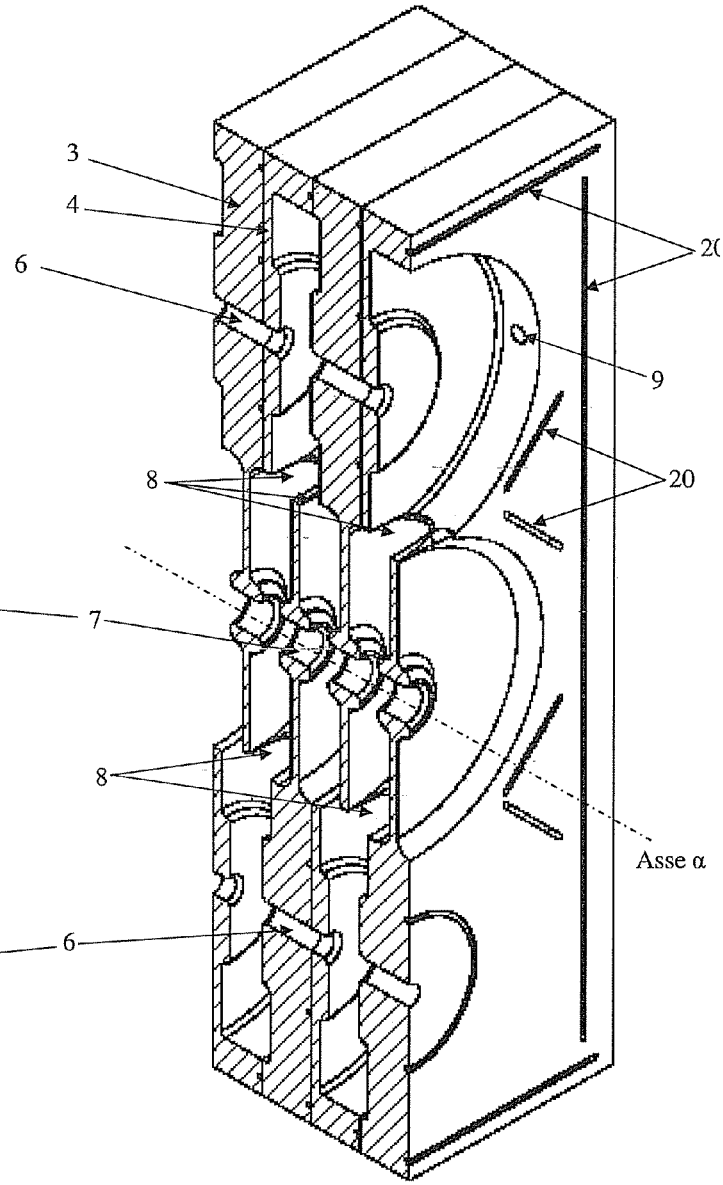
FIG. 6 shows an axonometric view of FIG. 2.

By directly comparing FIG. 1, which shows the state of the art, and FIG. 2, which is in accordance with the present invention, it is found that the thickness of the packs according to the present invention approximately doubles that of the known art, with the consequence that the number of packs object of the process is exactly half as compared to the known art, because the thickness R of each pack approximately doubles that of the packs of the known art.

The juxtaposition of a plurality of packs determines a first continuous alignment of N accelerating chambers in a mid-position with respect to the whole formed by the plurality and two symmetric and alternating alignments with respect to said first alignment, each formed by N/2 coupling chambers.

Therefore, said juxtaposition of the face 1*a* of a first pack on the face 1*b* of a second pack, must occur once the latter has been rotated by 180° with respect to its normal barycentric axis $\alpha$.

The first considerable advantage of the proposed configuration is found in that the partition 5 which divides two consecutive accelerating cavities belongs to only one pack, and the partition thickness results to be even less than half the thickness of the partition of the known art packs. Indeed, because the partition 5 belongs to only one pack, it is not subjected to brazing, and the thickness thereof can be reduced and the machining tolerance can be relaxed. Furthermore, the thickness reduction of the partition improves the efficiency of the cavity, the ratio between its internal volume divided by the internal surface of the cavity being proportional. The consequence is a considerable saving of the energy needed to feed the accelerator.

The fact that the cavity 12*a* is the major part of the coupling cavity 12 as compared to the remaining cavity 12*b*, in relation to the aforementioned juxtaposition causes a tapered zone 4 to be in contact with a thick zone 3 of the adjacent pack which serves as a support for the tapered zone 4, by continuously alternating.

The cavities belonging to the alignment of accelerating cavities are reciprocally communicating through a cross opening 7 obtained in each pack in a central position with respect to the cavities 11*a* and 11*b*, while the coupling cavities are connected to each other through further cross side openings 6, obtained in each pack, centrally with respect to the cavities 12*a* and 12*b*.

Figure 7:
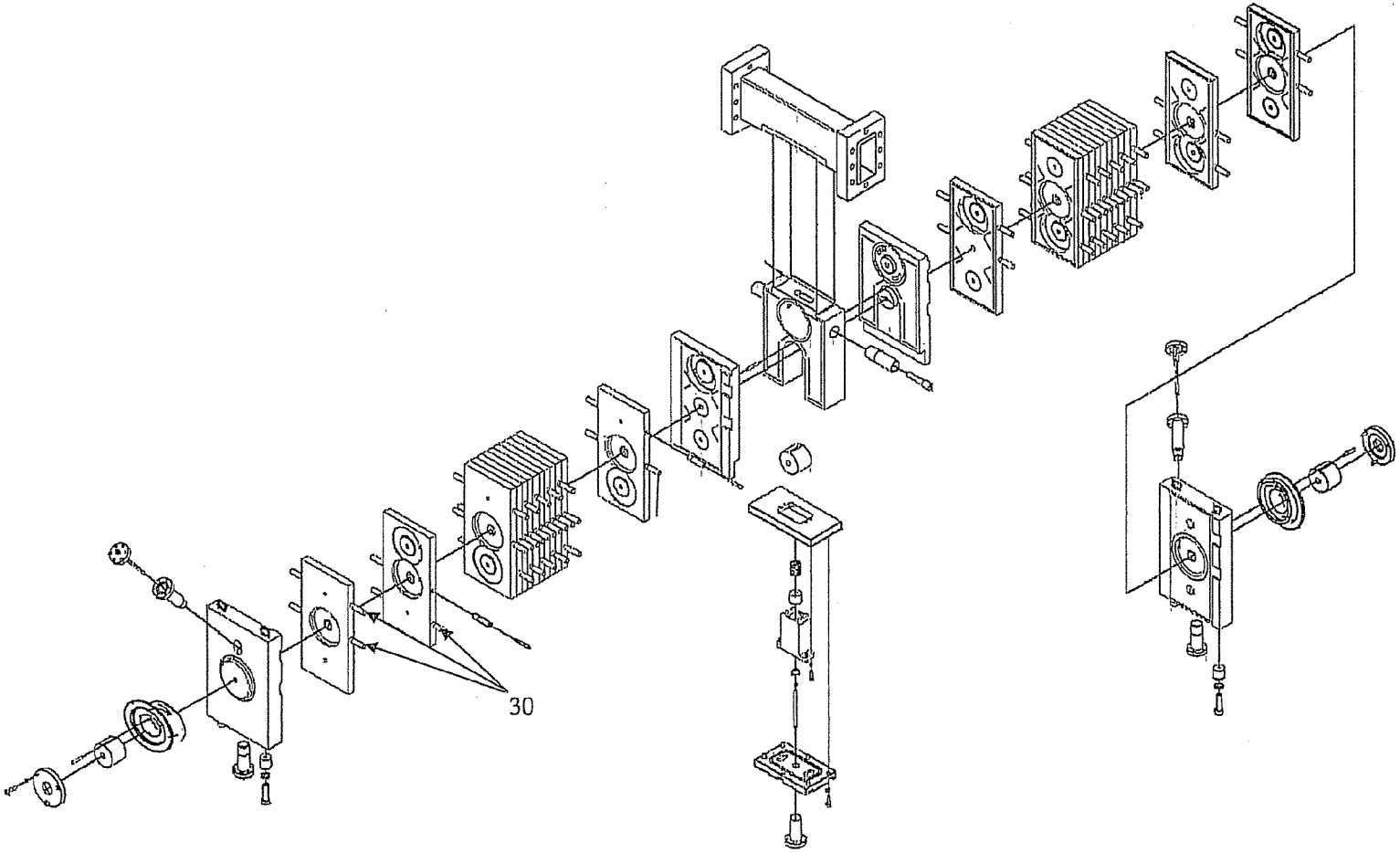
FIG. 7 shows an exploded axonometric view of an acceleration module in accordance with the invention.

The main consequence of the proposed configuration is thus that the thickness R of the packs approximately doubles that of the known art. This has allowed to make at least one hole 9, perpendicular to the thickness of the pack, in order to insert a pin 30 (see FIG. 7) to vary the resonance frequency of the cavity.

This aspect is extremely important because machining errors which normally lead the cavity not to resonate may be recovered by inserting/removing the pin 30 from the cavity through the hole 9.

The pins can be even more than one for a same cavity and may be made on any side of the pack in an essentially perpendicular manner with respect to the thickness or depth R of the pack.

Another unquestionable advantage of the proposed configuration is that the irises 8 which put two consecutive accelerating cavities 11 and a coupling cavity 12 into communication are obtained in a same pack, more specifically the machining may be such to simultaneously open the irises on both sides of the same partition 5, therefore also the irises 8 related to a same partition belong to the same pack. Grooves 20 adapted to be filled with filling material during the weld-brazing process are made on either one or both faces of the pack.

Therefore, the advantages which derive from the present invention are:

the machining process of half the packs;

a smaller thickness of the dividing partition 5 causing an efficiency increase of the module formed by the packs;

the possibility of using keying means 30 of the cavities;

a considerably relax in machining tolerances.

The specific embodiments herein described do not limit the contents of this application which covers all the variants of the invention defined in the claims.

The invention claimed is:

1. An accelerator tile, specifically for acceleration modules in a linac for low energy protons, the modules including a sequence of adjacent tiles, the tile being parallelepiped-shaped with a thickness smaller than the other dimensions and including a first middle cavity, located essentially in the middle of a first face of the tile, a first peripheral cavity on the first face of the tile, located at a first side of the tile with respect to the first middle cavity, a second peripheral cavity on a second face of the tile, opposite to the first face, said second peripheral cavity being located at a second side of the tile, opposite to the first side, with respect to the first middle cavity a second middle cavity on the second face, in a position corresponding to said first middle cavity, the first and the second middle cavities being divided by a partition wall integral with the tile and being arranged asymmetrical with respect to said partition wall, whereby, when the tile is arranged side-by-side with adjacent tiles in a sequence of tiles wherein the first face of a first tile is juxtaposed on the second face of a second tile and wherein first tile and second tile are 180° rotated one with respect to the other around a normal barycentric axis $\alpha$ thereof, the first middle cavity on the first face of the first tile and the second middle cavity on the second face of the second tile define an accelerating cavity while the first peripheral cavity on the first face of the first tile and the second peripheral cavity on the second face of the second tile define a coupling cavity.

2. The tile according to claim 1, including, perpendicularly to the depth (R) of the tile, at least one through opening reaching the accelerating cavity or the coupling cavity or a portion thereof and adapted to receive a keying pin.

3. The tile according to claim 1, wherein two irises related to the partition wall, adapted to put two accelerating cavities into communication with a coupling cavity, both belong to the tile.

4. A linear acceleration module for cyclotrons including a sequence of tiles according to claim 1, wherein in said sequence of tiles a first face of a first tile is juxtaposed on a second face of a second tile, said first tile and said second tile being 180° rotated one with respect to the other around a normal barycentric axis a thereof, whereby for each pair of adjacent tiles a first middle cavity on the first face of the first tile and a second middle cavity on the second face of the second tile define an accelerating cavity while a first peripheral cavity on the first face of the first tile and a second peripheral cavity on the second face of the second tile define a coupling cavity, the module thus having a first alignment of N accelerating cavities along said barycentric axis a and two symmetric and alternating alignments of N/2 coupling cavities with respect to said first alignment of N accelerating cavities.

5. The module according to claim 4, wherein there is provided, perpendicularly to the depth (R) of each tile, at least one through opening reaching the accelerating cavity or the coupling cavity, and wherein there is provided a keying pin, adapted to be inserted through said opening to key the accelerating cavity or the coupling cavity corresponding to the opening.

6. An accelerator tile, specifically for acceleration modules in a linac for low energy protons, the modules including a sequence of adjacent tiles, the tile being parallelepiped-shaped with a thickness smaller than the other dimensions and including a first middle cavity, located essentially in the middle of a first face of the tile, a first peripheral cavity on the first face of the tile, located at a first side of the tile with respect to the first middle cavity, a second peripheral cavity on a second face of the tile, located at a second side of the tile, opposite to the first side, with respect to the first middle cavity, a second middle cavity on the second face, in a position corresponding to said first middle cavity, the first and the second middle cavities being divided by a partition wall integral with the tile and being asymmetrically cut and arranged with respect to said partition wall, whereby, when the tile is arranged side-by-side with adjacent tiles in a sequence of tiles wherein the first face of a first tile is juxtaposed on the second face of a second tile and wherein first tile and second tile are 180° rotated one with respect to the other around a normal barycentric axis a thereof, the first middle cavity on the first face of the first tile and the second middle cavity on the second face of the second tile define an accelerating cavity while the first peripheral cavity on the first face of the first tile and the second peripheral cavity on the second face of the second tile define a coupling cavity.

* * * * *